United States Patent [19]

Irwin

[11] 3,966,356

[45] June 29, 1976

[54] BLADE TIP SEAL MOUNT

[75] Inventor: John A. Irwin, Indianapolis, Ind.

[73] Assignee: General Motors Corporation, Detroit, Mich.

[22] Filed: Sept. 22, 1975

[21] Appl. No.: 615,222

[52] U.S. Cl. ..... 415/217; 277/22

[51] Int. Cl.[2] ..... F01D 11/08; F04D 17/08

[58] Field of Search ..... 415/217, 136, 172, 174; 277/22, 26

[56] References Cited

UNITED STATES PATENTS

| | | | |
|---|---|---|---|
| 2,859,934 | 11/1958 | Halford et al. | 415/217 |
| 2,997,275 | 8/1961 | Bean et al. | 415/217 |
| 3,146,992 | 9/1964 | Farrell | 415/136 |
| 3,669,563 | 6/1972 | Corbett | 415/217 |
| 3,887,299 | 6/1975 | Profant | 415/174 |

*Primary Examiner*—Robert I. Smith

*Attorney, Agent, or Firm*—J. C. Evans

[57] ABSTRACT

A stationary annular rotor blade tip seal assembly includes an annular support extending continuously circumferentially around and radially outwardly of the tips of a plurality of blades on a turbine rotor. A seal mount ring includes a plural number of seal mount segments retained axially of the annular support and having circumferential ends on each of the adjacent segments spaced apart to receive a retaining spring and seal strip. A low density seal insert is mounted on each of the seal mount segments and is spring biased into seated engagement with each of the seal mount segments by the retaining spring with the seal strip closing a gap between each of the low density seal inserts.

3 Claims, 4 Drawing Figures

BLADE TIP SEAL MOUNT

The invention described herein was made in the course of work under a contract with the Department of Defense.

This invention relates to rotor shroud assemblies and more particularly to an annular rotor blade tip seal assembly having low density inserts for maintaining a desired clearance between the seal assembly and the radially outermost tips of a plurality of rotor blades enclosed circumferentially by the seal assembly.

Gas turbine engines that operate under elevated temperature conditions have a turbine rotor with a plurality of blades thereon which are subjected to elevated temperature of motive fluid passed thereacross for supplying power to an output shaft. In such arrangements, the elevated temperature causes the tips of each of the turbine rotor blades to expand radially outwardly requiring means to compensate for differences in thermal expansion between the turbine rotor and a radially outwardly located circumferentially arranged rotor shroud assembly.

It is an object of the present invention to provide an improved seal assembly for maintaining a controlled clearance between the radially outermost tips of blades of a turbine rotor and an annular shroud assembly in circumferential surrounding relationship to the blade tips to do so by means of a resiliently supported plurality of low density abradable seal inserts that will engage the tips under elevated operating temperatures to compensate for differences in thermal expansion between the blades and shroud.

Still another object of the present invention is to provide an improved, easily assembled stationary annular rotor blade tip seal arrangement having low density abradable seal inserts supported by a plural number of seal mount segments connected axially of an annular support extending continuously circumferentially around the rotor blade and wherein a retaining spring element is interposed between each of the seal mount segments including means for resiliently biasing each of the low density abradable seal inserts against an adjacent seal mount segment and further including means to prevent circumferential movement of the inserts with respect to the annular support.

Yet another object of the present invention is to provide a stationary annular rotor blade tip seal assembly for use in a turbine stage of a gas turbine engine including an annular support extending circumferentially around the radially outermost tips of rotor blades and wherein a plurality of seal mount segments are retained axially on the support by means of a tongue and groove connection with each of the seal mount segments having their circumferential ends spaced apart to receive a retaining spring and seal strip and wherein each of the seal mount segments have a pair of spaced parallel rebent flanges thereon to define a slot to receive a low density abradable seal insert having spaced apart circumferential ends engaged by the seal strip to form a continuously sealed outer perimeter around the radial tips of the rotor blades and wherein the abradable seal inserts are engageable by the rotor tip upon operation at elevated temperatures to form a controlled clearance between the rotor and the stationary annular rotor blade tip seal assembly.

Further objects and advantages of the present invention will be apparent from the following description, reference being had to the accompanying drawings wherein a preferred embodiment of the present invention is clearly shown.

Figure 1:
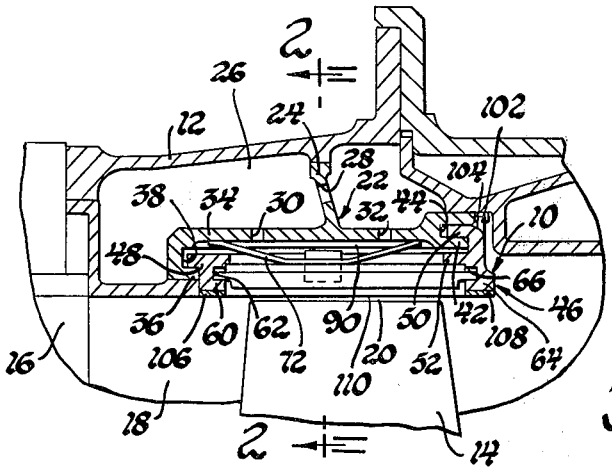
FIG. 1 is a fragmentary view in vertical section of a stationary annular rotor blade tip seal assembly of the present invention.

Referring now to the drawings, in FIG. 1 a stationary annular rotor blade tip seal assembly 10 is illustrated supported on a turbine engine case 12 of annular configuration. The assembly 10 is shown in association with a blade 14 of a turbine rotor having a plurality of circumferentially spaced blades of like configuration supported on a wheel that is driven by motive fluid from a turbine combustor directed through a turbine nozzle 16 into an inlet passage 18 for flow across the turbine rotor.

In such arrangements, the motive fluid discharge from the nozzle 16 into the inlet passage 18 is at a substantially elevated temperature causing a tip 20 on each of the blades 14 to expand with respect to the seal assembly 10.

In order to compensate for differential expansion between the seal assembly 10 on the turbine case 12 and the tips 20 of the rotor blades 14, the seal assembly 10 includes an annular support 22 with an upstanding rib 24 thereon located in a cooling air cavity 26. The rib 24 includes an opening 28 therein for distributing cooling air through passages 30, 32 in the radially outermost wall 34 of the support 22. The support includes a continuously circumferentially formed flange 36 on one side thereof that forms a continuously circumferentially formed groove 38 thereon. The opposite side of the wall 34 includes a radially outwardly located axial flange 40 in spaced parallelism with a radially inwardly located axial flange 42 both formed continuously circumferentially therearound to form a groove 44 on the opposite side of the support 22 from the groove 38 therein at a point spaced radially of groove 38.

Additionally the seal assembly 10 includes a plurality of separate seal mount segments 46 each having a tongue 48 on one side thereof that is supportingly received within the goove 38 and each having a pair of spaced apart tongues 50, 52 on the opposite side thereof with the tongue 50 being located in the groove 44 and the flange 42 being located between the tongues 50, 52 for retaining each of the segments 46 on the annular support 22.

Figure 2:
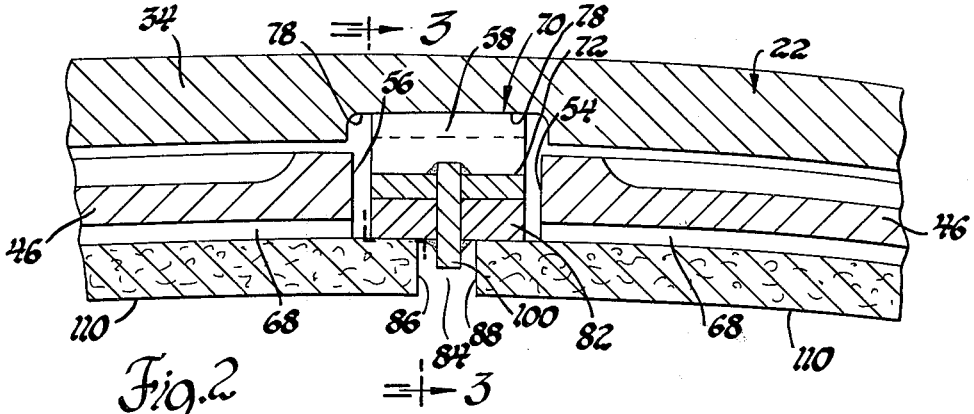
FIG. 2 is an enlarged vertical sectional view taken along the line 2—2 of FIG. 1 looking in the direction of the arrows.
Figure 3:
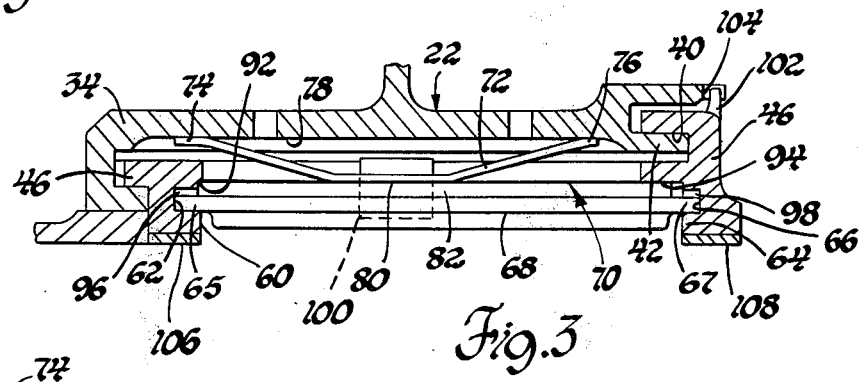
FIG. 3 is a vertical sectional view taken along the line 3—3 of FIG. 2 looking in the direction of the arrows.
Figure 4:
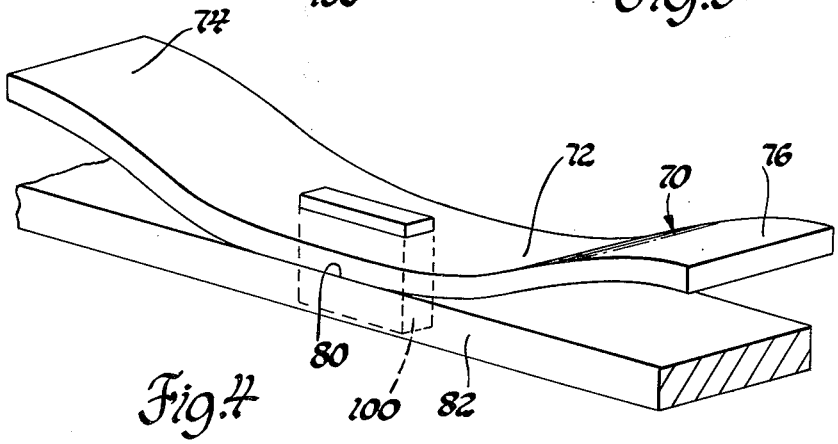
FIG. 4 is a view in perspective of a retaining spring and seal strip utilized in the present invention.

As best seen in FIG. 2, each of the seal mount segments 46 has circumferential ends 54, 56 thereon located in juxtaposed spaced relationship to form a gap 58 therebetween. Furthermore, each of the seal mount segments 46 includes a first rebent flange 60 on one side thereof to define a circumferentially extending slot 62 and a like oppositely facing rebent flange 64 on the opposite side thereof forming a circumferentially extending slot 66. The slots 62, 66 supportingly receive side flanges 65, 67 formed on opposite sides of a low density seal insert 68 formed of an abradable silicon carbide material which constitutes the active element of the seal assembly 10. As is best seen in FIG. 3, each of the low density seal inserts 68 is fit in the slots 62, 66 of one of the seal mount segments 46 to be supported thereon in radially outwardly spaced relationship to the tips 20 on each of the blades 14.

A combination spring and seal strip unit 70 is located in each of the gaps 58. It includes a leaf spring 72 having opposite end portions 74, 76 thereon in engagement with an inner surface 78 of the outer wall 34 of the support 22. The leaf spring 72 has a bight portion 80 thereon secured to the mid-point of a seal strip 82 that bridges a gap 84 between opposite circumferential ends 86, 88 on adjacent inserts 68. The spring 72 biases the seal strip 82 against the ends of the inserts 68 to prevent cooling air leakage from cavity 90 formed between support 22 and each of the seal mount segments 46. Shoulders 92, 94 are formed on each side of the seal mount segments 46 to locate each of the seal strips 82.

Cooling air is forced as jets through the passages 30, 32 into the cavity 90 to cool each of the leaf springs 72. Each of the seal strips 82 is spaced at its opposite ends from the circumferentially extending slots 62, 66 to form a clearance space 96, 98 on each side thereof for allowing the cooling air to be discharged from the ends of the slot.

Additionally, each unit 70 includes a tang 100 that extends into the gap 84 to prevent circumferential movement of each of the inserts 68 with respect to the seal mount segments 46. The seal mount segments 46 are indexed to the annular support 22 by means of a tang 102 that fits into a slot 104 in the member 22.

Each of the mount segments 46 includes a thermal barrier layer 106, 108 on each side thereof exposed to the inlet passage 18 and the discharge side of each of the rotor blades 14 to reduce heating of the assembly 10 by the motive fluid passing across each of the rotor blades 14.

The aforedescribed seal assembly 10 forms a radially outwardly located continuous circumferential surface of abradable material at the outer tips 20 so that as relative thermal expansion between the blades 14 of the assembly 10 occurs, each of the tips 20 will contact the inner surface 110 of each of the low density seal inserts 68 to abrade part of the material to form a close clearance gap between the seal assembly 10 and the tips 20 so as to improve turbine efficiency.

The abradable low density seal inserts 68 are easily assembled on the support 22 by means of the separate plurality of seal mount segments 46 and are spring biased thereagainst and indexed with respect thereto by the spring element 72 of each of the units 70 along with the tang 100 formed thereon. Each insert 68 is placed on a mount segment 46 along with unit 70. Segments 46 are located on the support 22 by axial insertion from downstream end of passageway 18. Thereafter they are retained by wall 105.

While the embodiment of the present invention, as herein disclosed, constitutes a preferred form, it is to be understood that other forms might be adopted.

The embodiments of the invention in which an exclusive property or privilege is claimed are defined as follows:

1. A stationary annular rotor blade tip seal for a turbomachine comprising, in combination, an annular support extending circumferentially around the rotor blades, a seal mount ring composed of a plural number of seal mount segments retained by the support, the circumferential ends of adjacent segments being justaposed with gaps between the segments, the axial edges of the segments having rebent flanges defining a circumferentially extending slot, a low density seal insert mounted in the slot in each segment and retained by the flanges, resilient means for biasing the insert against the said rebent flanges, and strips mounted on the juxtaposed ends of the segments bridging the gaps between the segments, the strips including portions extending between adjacent inserts to retain the inserts against circumferential movement.

2. A stationary annular rotor blade tip seal for a turbomachine comprising, in combination, an annular support extending circumferentially around the rotor blades, a seal mount ring composed of a plural number of seal mount segments retained by the support, the circumferential ends of adjacent segments being juxtaposed with gaps between the segments, the axial edges of the segments having rebent flanges defining a circumferentially extending slot, a low density seal insert mounted in the slot in each segment and retained by the flanges, seal strips mounted on the juxtaposed ends of the segments bridging the gaps between the segments, and resilient means engaging the annular support and said strips to bias the insert against the said rebent flanges.

3. A stationary annular rotor blade tip seal for a turbomachine comprising, in combination, an annular support extending circumferentially around the rotor blades, a seal mount ring composed of a plural number of seal mount segments retained by the support, the circumferential ends of adjacent segments being juxtaposed with gaps between the segments, the axial edges of the segments having rebent flanges defining a circumferentially extending slot, a low density seal insert mounted in the slot in each segment and retained by the flanges, resilient means for biasing the insert against the said rebent flanges, and strips mounted on the juxtaposed ends of the segments bridging the gaps between the segments, the strips including portions extending between adjacent inserts to retain the inserts against circumferential movement, means for directing flow of cooling air across said resilient means, and the strips having clearance from the ends of the slots to allow the cooling air to be discharged from the ends of the slots.

* * * * *